US008378897B2

(12) United States Patent
Lai et al.

(10) Patent No.: US 8,378,897 B2
(45) Date of Patent: Feb. 19, 2013

(54) PLANAR MULTI-BAND ANTENNA

(75) Inventors: Ming-Iu Lai, Taipei (TW); Chun-Hsiung Wang, Taipei (TW)

(73) Assignee: Asustek Computer Inc., Taipei (TW)

( * ) Notice: Subject to any disclaimer, the term of this patent is extended or adjusted under 35 U.S.C. 154(b) by 310 days.

(21) Appl. No.: 12/908,491

(22) Filed: Oct. 20, 2010

(65) Prior Publication Data

US 2011/0095952 A1 Apr. 28, 2011

(30) Foreign Application Priority Data

Oct. 26, 2009 (TW) ..... 98136236 A

(51) Int. Cl.
*H01Q 1/38* (2006.01)

(52) U.S. Cl. ..... 343/700 MS; 343/702

(58) Field of Classification Search ..... 343/700 MS, 343/702, 846, 848
See application file for complete search history.

(56) References Cited

U.S. PATENT DOCUMENTS

| | | | | |
|---|---|---|---|---|
| 7,525,490 | B2 | 4/2009 | Hung et al. | |
| 2002/0000949 | A1 | 1/2002 | Nishino et al. | |
| 2004/0239442 | A1 | 12/2004 | Wilcox | |
| 2005/0110692 | A1* | 5/2005 | Andersson | 343/702 |
| 2006/0109175 | A1 | 5/2006 | Yeh | |
| 2007/0069958 | A1* | 3/2007 | Ozkar | 343/700 MS |
| 2007/0285321 | A1 | 12/2007 | Chung et al. | |
| 2008/0180330 | A1 | 7/2008 | Wei-Shan et al. | |
| 2009/0195473 | A1* | 8/2009 | Ke et al. | 343/846 |
| 2010/0253581 | A1* | 10/2010 | Tsou | 343/702 |
| 2011/0032170 | A1* | 2/2011 | Chiang et al. | 343/860 |

FOREIGN PATENT DOCUMENTS

| | | | |
|---|---|---|---|
| CN | 1795617 | A | 6/2006 |
| CN | 201004480 | Y | 1/2008 |

* cited by examiner

*Primary Examiner* — Hoanganh Le
(74) *Attorney, Agent, or Firm* — Muncy, Geissler, Olds & Lowe, PLLC

(57) ABSTRACT

A planar multi-band antenna includes a substrate and a metal pattern. The metal pattern includes a first metal wire, a second metal wire, a third metal wire and a fourth metal wire. The second metal wire is disposed opposite to the first metal wire and has a grounding point. Two ends of the third metal wire are connected to the first metal wire and second metal wire, respectively, and the first metal wire is divided into a first radiation portion and a second radiation portion. The fourth metal wire is partially located between the second radiation portion and the second metal wire and forms multiple bends, and has a first impedance matching portion and a feed point, and part of the fourth metal wire coincides with the second radiation portion in a projection direction. By the activation of the feeding point and the grounding point associates with the impedance matching portion, the antenna has plural bands.

16 Claims, 6 Drawing Sheets

PLANAR MULTI-BAND ANTENNA

CROSS REFERENCE TO RELATED APPLICATIONS

This Non-provisional application claims priority under 35 U.S.C. §119(a) on Patent Application No(s). 098136236 filed in Taiwan, Republic of China on Oct. 26, 2009, the entire contents of which are hereby incorporated by reference.

BACKGROUND OF THE INVENTION

1. Field of Invention

The invention relates to an antenna and, more particularly, to a planar multi-band antenna.

2. Related Art

Wireless transmission is widely used in electronic products. To satisfy the demand of the users, most electronic devices nowadays have wireless transmission functions. In the wireless transmission system, antenna is one of important elements for transmitting and receiving signals. Without antennas, the wireless transmission system cannot transmit and receive data. Therefore, the antenna is necessary in wireless transmission systems.

Planar Inverter-F antenna (PIFA) is a common antenna architecture nowadays. Such structure can be used to design a single-band antenna, a dual-band antenna and a multi-band antenna. FIG. 1 is a schematic diagram showing a conventional PIFA. Three antennas 11, 12 and 13 are PIFA, and they may have the same or different frequencies. An antenna for notebook computer applications shall be long and narrow, taking the antenna 11 as an example, in the long and narrow space, segments $A_1B_1D_1$ and $A_1B_1C_1$ are operated in a $\lambda/4$ mode. Since other high modes operate at higher frequencies (such as a $3\lambda/4$ mode), or they are hard to be excited (such as a $\lambda/2$ and a $\lambda$ mode), the PIFA architecture is hard to achieve a dual broadband antenna or a broadband antenna.

SUMMARY OF THE INVENTION

The invention discloses an antenna that has the dual broadband or the broadband features.

To achieve the objective above, a planar multi-band antenna is disclosed. The planar multi-band antenna includes a substrate and a metal pattern. The metal pattern is formed on the substrate, and it has a first metal wire, a second metal wire, a third metal wire and a fourth metal wire. The second metal wire is disposed opposite to the first metal wire and has a grounding point. Two ends of the third metal wire are connected to the first metal wire and second metal wire, respectively, to divide the first metal wire into a first radiation portion and a second radiation portion. The fourth metal wire is partially located between the second radiation portion and the second metal wire, and forms multiple bends. The fourth metal wire has a first impedance matching portion and a feed point. In addition, part of the fourth metal wire coincides with the second radiation portion in the projection direction.

After the planar multi-band antenna is excited between the feed point and the grounding point, the operating band of the antenna may be divided into multiple bands such as four bands. Part of the fourth metal wire may work in a fourth bandwidth, and by which, other segments of the wires may be activated to work in a first bandwidth, a second bandwidth and a third bandwidth. Since each operating band is staggered with each other, the antenna may be the broadband antenna. In addition, the reflection coefficient of the antenna can be adjusted finely via the first impedance matching portion of the invention to increase the band width of the antenna, thereby making the antenna have the broadband character. In addition, part of the fourth metal wire coincides with the second radiation portion in the projection direction to reduce the size of the antenna and improve the competence of product.

These and other features, aspects and advantages of the present invention will become better understood with regard to the following description, appended claims, and accompanying drawings.

DETAILED DESCRIPTION OF THE INVENTION

In the following part, a planar multi-band antenna is illustrated according to an embodiment of the invention.

Figure 1:
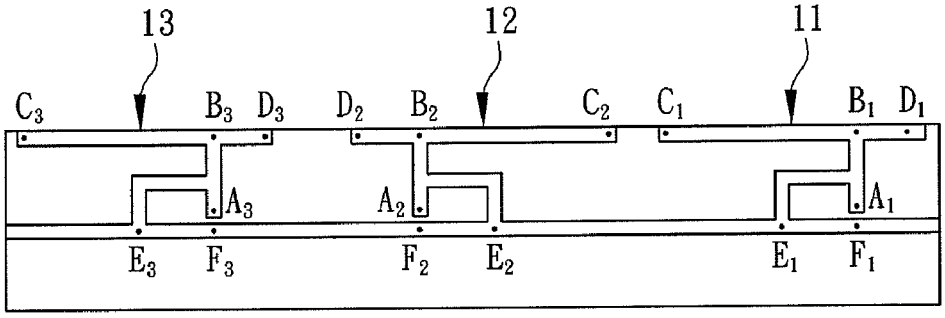
FIG. 1(Prior Art)
FIG. 1 is a schematic diagram showing a conventional PIFA.
Figure 2:
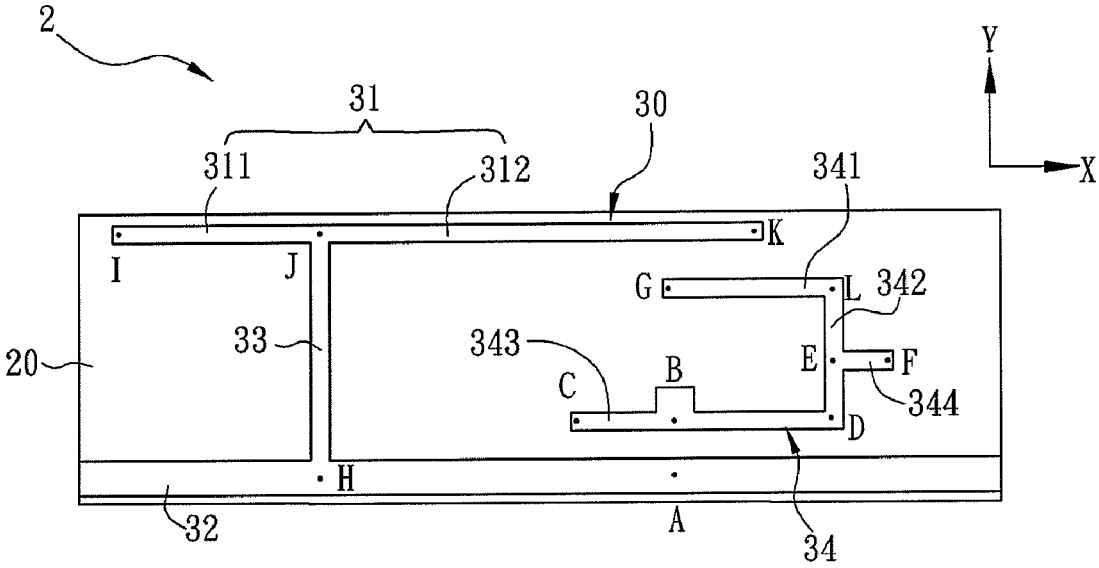
FIG. 2 is a schematic diagram showing the planar multi-band antenna in a first embodiment of the invention.

As shown in FIG. 2, a planar multi-band antenna 2 in an embodiment of the invention includes a substrate 20 and a metal pattern 30. In the embodiment, the substrate 20 includes but not limited to a glass substrate, a plastic substrate, a circuit substrate or other kinds of substrate.

The metal pattern 30 is formed on the substrate 20 and used as the main working body of the planar multi-band antenna 2. The segments of the metal pattern 30 are made of conducting materials such as but not limited to metal or alloy or high polymer conducting material. Any conducting material can be made to be the metal pattern 30.

The metal pattern 30 includes a first metal wire 31, a second metal wire 32, a third metal wire 33 and a fourth metal wire 34. In the embodiment, the first metal wire 31 is segments IJK, and the second metal wire 32 is disposed opposite to the first metal wire 31 and has a grounding point. The second metal wire 32 in the embodiment is a segment AH and an extending segment of the segment AH, and the grounding point is point A.

Two ends of the third metal wire 33 are respectively connected to the first metal wire 31 and the second metal wire 32, and the first metal wire 31 is divided into a first radiation portion 311 and a second radiation portion 312. The third metal wire 33 herein is a segment JH, the first radiation portion 311 is a segment IJ, and the second radiation portion is a segment JK. In addition, the first metal wire 31 and the third metal wire 33 may be in a T shape or a Y shape, and the T-type is taken as an example herein. In addition, the first metal wire 31, the second metal wire 32 and the third metal wire 33 may be in an "I" shape.

The fourth metal wire 34 has at least a part located between the second radiation portion 312 and the second metal wire 32, and it is not connected to the first metal wire 31, the second metal wire 32 and the third metal wire 33. The fourth metal wire 34 forms multiple bends. The fourth metal wire 34 herein has a third radiation portion 341, a fourth radiation portion 342 and a first impedance matching portion 343. The third radiation portion 341 is a segment GL, and the fourth radiation portion 343 is a segment DL. The first impedance matching portion 343 is a segment CD, and the third radiation portion 341 and the fourth radiation portion 342 form a bend. The fourth radiation portion 342 and the first impedance matching portion 343 form another bend.

The third radiation portion 341 and the second radiation portion 312 are parallel to each other, and at least a part of the third radiation portion 341 coincides with the second radiation portion 312 in the projection direction. The projection direction herein is the Y direction. The first impedance matching portion 343 is disposed between the second radiation portion 312 and the second metal wire 32, and part of the first impedance matching portion 343 coincides the second radiation portion 342 in the projection direction. In addition, in the embodiment, the third radiation portion 341 is disposed between the second radiation portion 312 and the first impedance matching portion 343.

One end of the fourth radiation portion 342 is connected to one end of the third radiation portion 341, and the other end of the fourth radiation portion 342 is connected to an end of the first impedance matching portion 343. The third radiation portion 341, the fourth radiation portion 342 and the first impedance matching portion 343 may be in an "U" shape, and the opening of the "U" shape is towards the third metal-wire 33.

Figure 3:
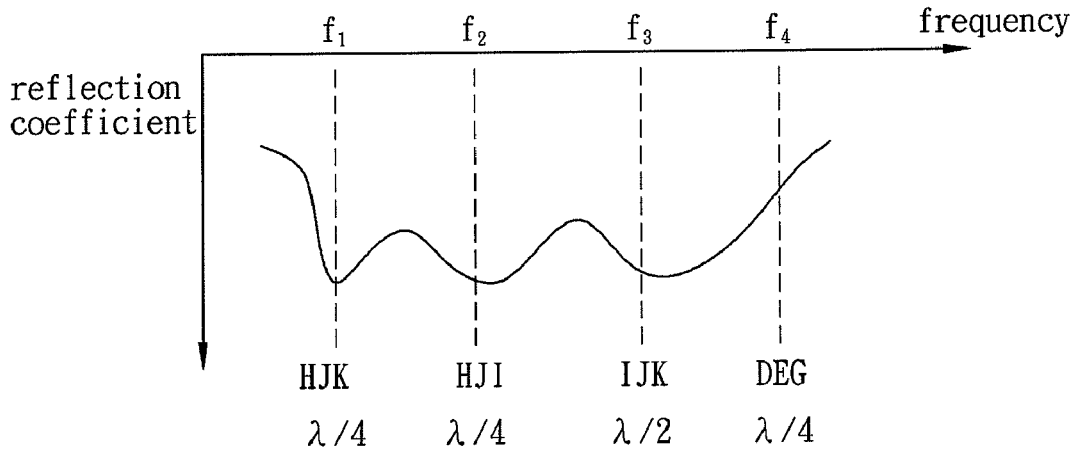
FIG. 3 is a schematic diagram showing the relation between the designed operating band and the reflection coefficient in the first embodiment of the invention.

The first impedance matching portion 343 has a feed point, and the feed point herein is a point B. In the embodiment, the grounding point A and the feed point B are disposed oppositely. FIG. 3 is a schematic diagram showing the operating band and reflection coefficient in the antenna in the embodiment of the invention. As shown in FIG. 2 and FIG. 3, with the activation of the feed point and the grounding point, the third radiation portion 341 and the fourth radiation portion 342 (segments DELG) are operated in a fourth bandwidth (operated in the $\lambda/4$ mode), and the third radiation portion 341 and the fourth radiation portion 342 are used to activate other segments to radiate. The first radiation portion 311 and the second radiation portion 312 (segments IJK) are operated in a third frequency $f_3$ (in the $\lambda/2$ mode). The third metal wire 33 and the first radiation portion 311 (segments HJI) are operated in the second bandwidth $f_2$ (in the $\lambda/4$ mode). The third metal wire 33 and the second radiation portion 312 (segments HJK) are operated in the first bandwidth $f_1$ (in the $\lambda/4$ mode).

In addition, the first impedance matching portion 343 is used as the matching circuit to adjust the reflection coefficient finely to make the operating bands in an available scope in which the reflection coefficient is smaller than −6 dB. In the first impedance matching portion 343, the segment BC is equivalent to a capacitor, and the segment BD is equivalent to a series inductor. Since the operating bands of the radiation portions are staggered with each other, the antenna with broadband is obtained.

In addition, the planar multi-band antenna 2 in the embodiment further may include a second impedance matching portion 344, and it is protruded from the fourth radiation portion 342. The second impedance matching portion 344 herein is protruded from the point E, and it is in parallel with the third radiation portion 341 and the first impedance matching portion 343. Similarly, the second impedance matching portion 344 which is used as a matching circuit also may adjust the reflection coefficient finely to enlarge the operating band of the antenna.

Figure 4:
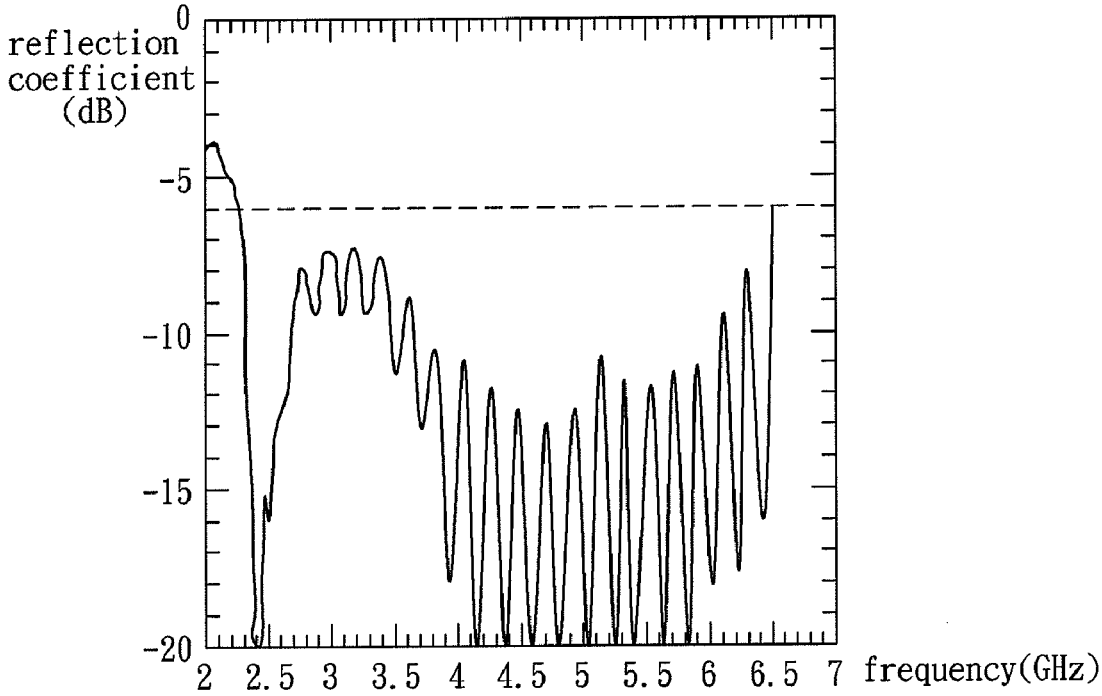
FIG. 4 is a schematic diagram showing the relation between the actual measured reflection coefficient and the operating band in the first embodiment of the invention.

As shown in FIG. 4, it is a schematic diagram showing the relation between the actual measured reflection coefficient and operating band when the antenna is assembled on the top left of a notebook computer. In the embodiment, the length of the antenna is 20 millimeter (mm), and the height is 7.5 mm, but the band width exceeds 4 GHz, which is adapted to wireless area network (WLAN a/b/g), worldwide interoperability for microwave access (WiMAX) and ultra width band (UWB) and other operating bands.

The planar multi-band antenna 2 and the drawings in the embodiment are just examples for illustration, and the invention is not limited thereto. In practical usage, to meet the selected operating band and band width, the size, the shape and the segment width of the antenna also may be adjusted.

Figure 5:
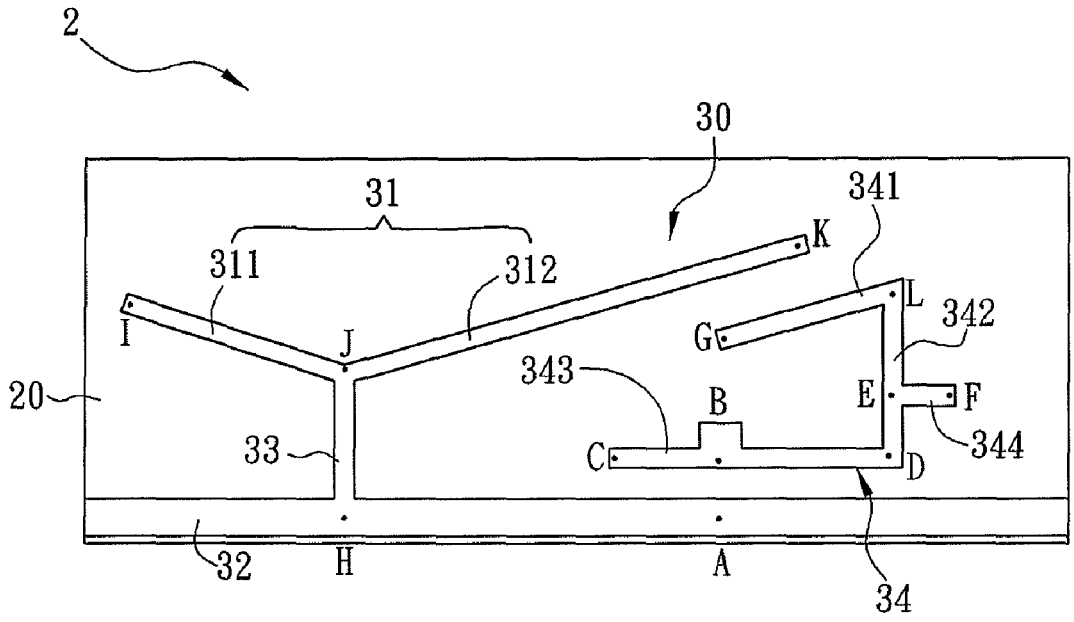
FIG. 5 to FIG. 8 are schematic diagrams showing planar multi-band antennas in a second to a fifth embodiment of the invention.

FIG. 5 to FIG. 8 are schematic diagrams showing the planar multi-band antenna 2 in a second to a fifth embodiment. As shown in FIG. 5, the first metal wire 31 (segments IJK) and the third metal wire 33 (the segment JH) are in a Y shape, and the third radiation portion 341 (the segment GL) and the second radiation portion 312 (the segment JK) are parallel with each other. In addition, in another embodiment, the first metal wire 31 may be parallel, which is the same as the segment IJ in FIG. 2, and the segment JK is oblique, which is the same as the segment JK in FIG. 5.

Figure 6:
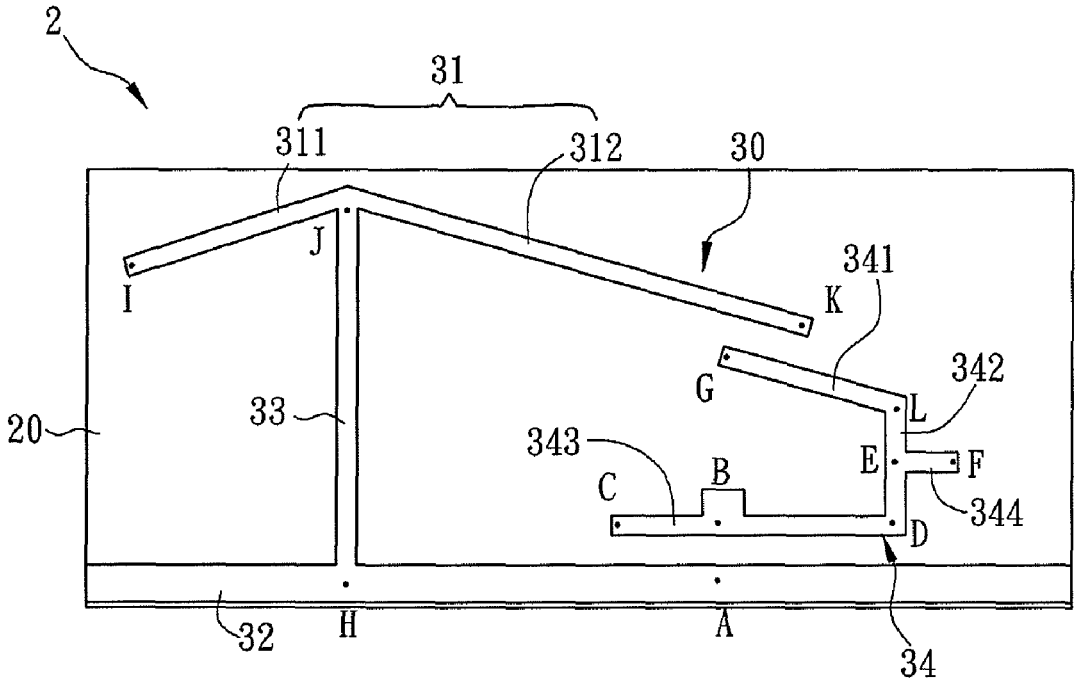

As shown in FIG. 6, the first metal wire 31 and the third metal wire 33 are in a "↑" shape, and the third radiation portion 341 and the second, radiation portion 312 are parallel with each other.

Figure 7:
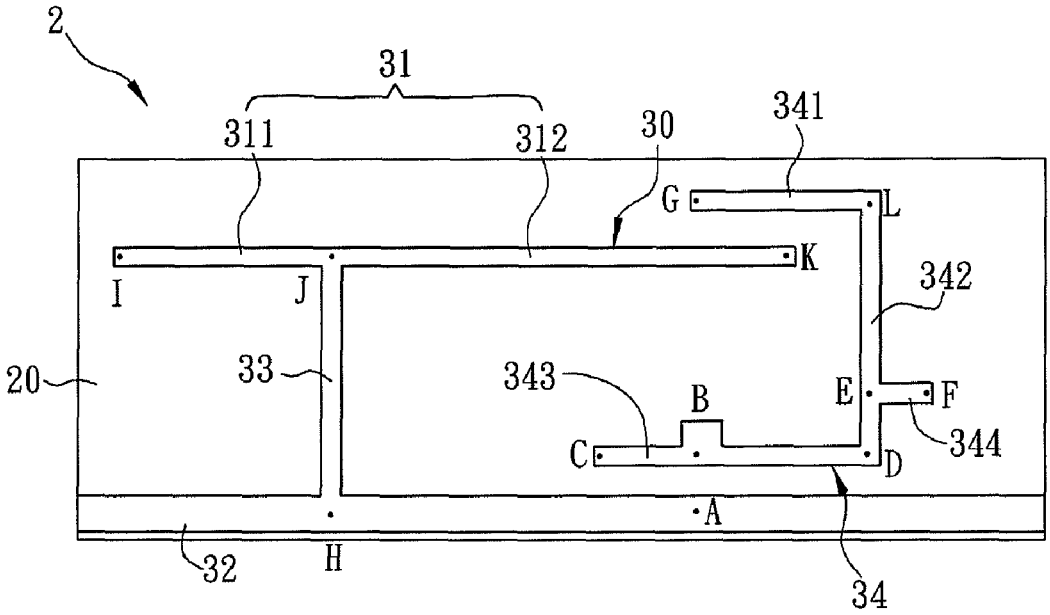

As shown in FIG. 7, the difference between the embodiment and the above embodiments is that the second radiation portion 312 is disposed between the third radiation portion 341 and the first impedance matching portion 343. The third radiation portion 341 and the second radiation portion 312 are parallel with each other.

Figure 8:
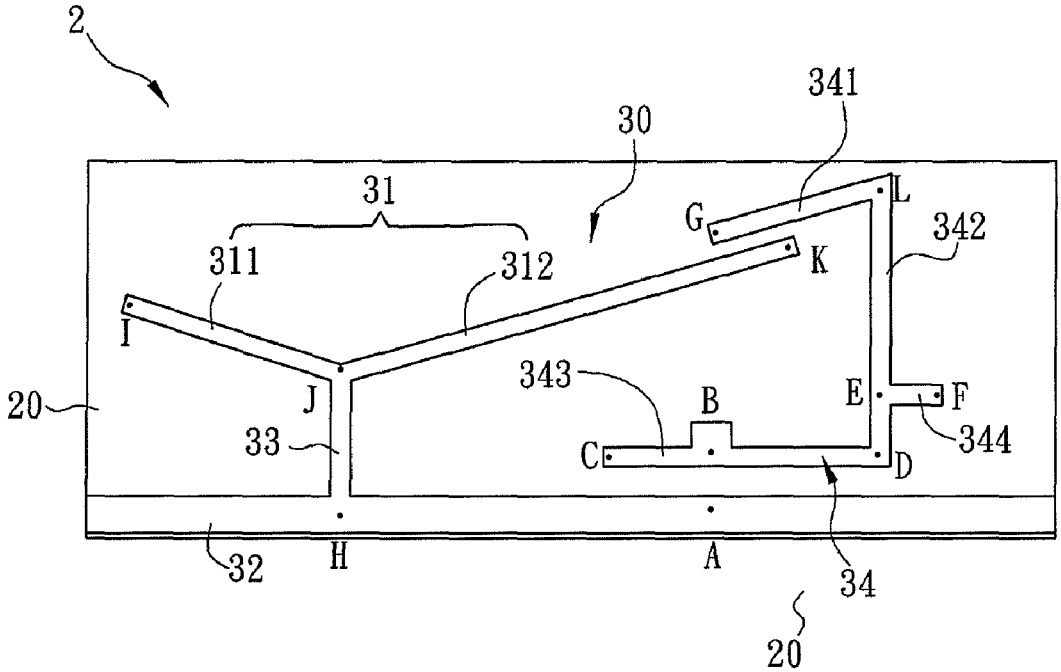

As shown in FIG. 8, the second radiation portion 312 is disposed between the third radiation portion 341 and the first impedance matching portion 343, and the first metal wire 31 and the third metal wire 33 are in a "Y" shape. In addition, the third radiation portion 341 and the second radiation portion 312 are parallel with each other.

Figure 9:
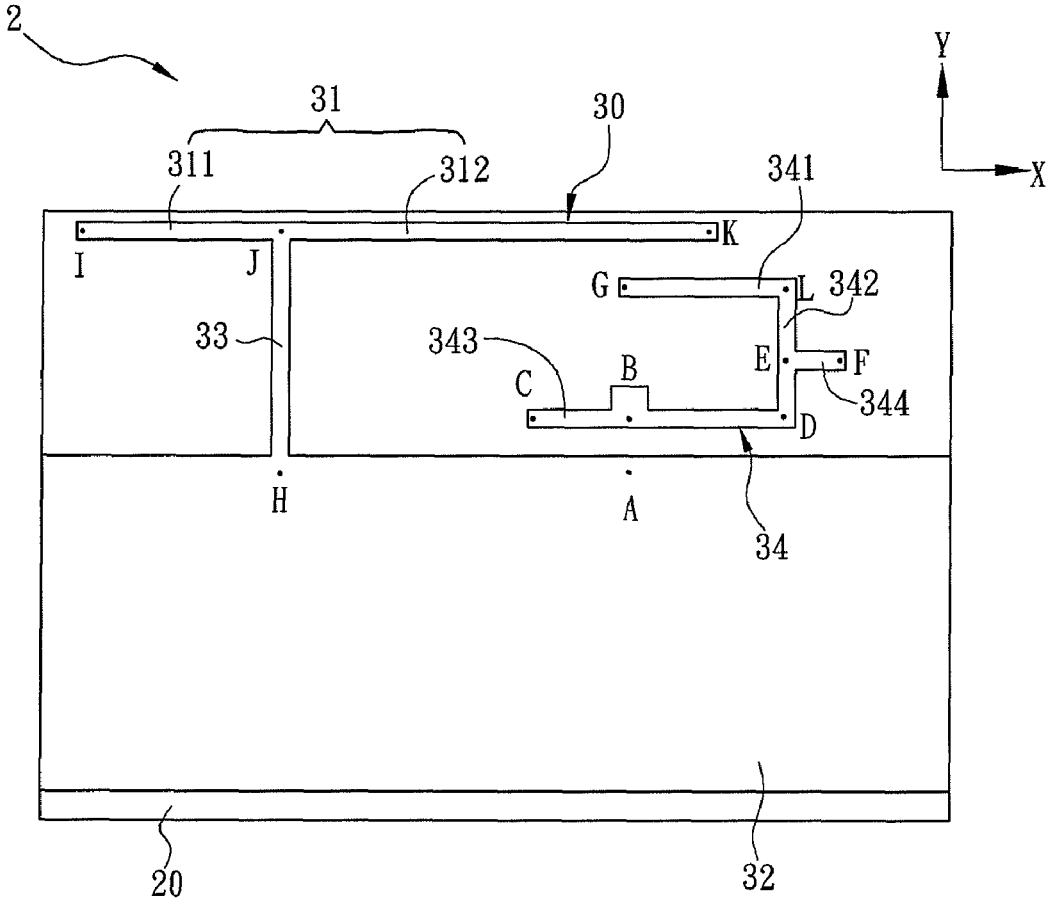
FIG. 9 is a schematic diagram showing an antenna with a planar second metal wire in a sixth embodiment of the invention.
Figure 10:
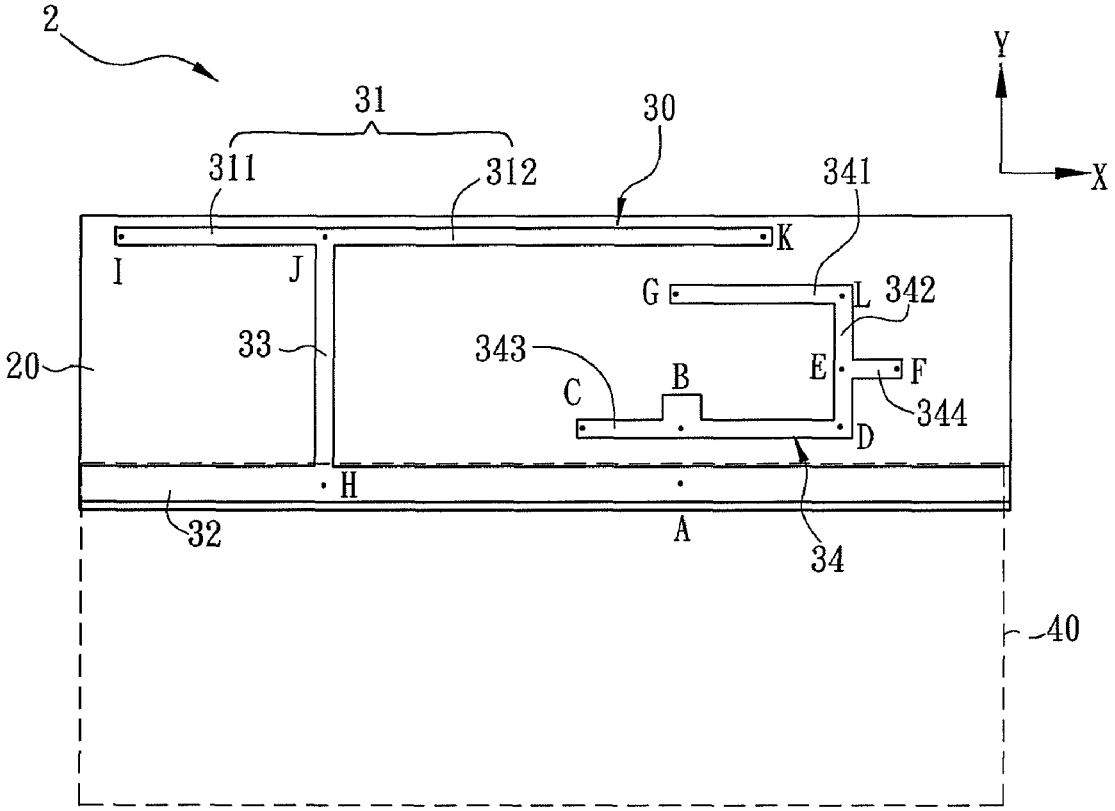
FIG. 10 is a schematic diagram showing an antenna having a metal sheet in a seventh embodiment of the invention.

In addition, FIG. 9 is a schematic diagram showing a planar multi-band antenna 2 in a sixth embodiment. As shown in FIG. 9, the difference between the planar multi-band antenna 2 in the above embodiments and the planar multi-band antenna in this embodiment is that the second metal wire 32 of the planar multi-band antenna 2 herein is planar, and the grounding area is expanded to facilitate the radiation of the antenna. FIG. 10 is a schematic diagram showing a planar multi-band antenna 2 in a seventh embodiment. As shown in FIG. 10, the planar multi-band antenna 2 further includes a metal sheet 40, and the metal sheet 40 is electrically connected to the second metal wire 32 and covers the second metal wire 32 and extends downwardly to be the grounding surface of the planar multi-band antenna 2, thereby enlarging the grounding area to facilitate the radiation of the antenna.

To sum up, in the planar multi-band antenna of the invention, by the activation of the feed point and the grounding point, the operating band of the antenna may be divided into multiple bands, such as four bands. The third radiation portion and the fourth radiation portion may be operated in the fourth bandwidth, and they are used to activate radiation of other segments to work in the first bandwidth, the second bandwidth and the third bandwidth. Since the operating bands are staggered with each other, an antenna with a broadband is obtained. In addition, the reflection coefficient of antenna may be adjusted finely via the first impedance matching portion, the band width of the antenna may be enlarged, and the antenna therefore has multi-width band. Furthermore, at least a part of the third radiation portion coincides with the second radiation portion in the projection direction, and at least a part of the first impedance matching portion coincides with the second radiation portion in the projection direction, thereby reducing the size of the antenna and improving the competence of product.

Although the present invention has been described in considerable detail with reference to certain preferred embodiments thereof, the disclosure is not for limiting the scope of the invention. Persons having ordinary skill in the art may make various modifications and changes without departing from the scope. Therefore, the scope of the appended claims should not be limited to the description of the preferred embodiments described above.

What is claimed is:

1. A planar multi-band antenna comprising:

a substrate; and a metal pattern formed on the substrate, including a first metal wire;

a second metal wire disposed opposite to the first metal wire and having a grounding point;

a third metal wire having two ends of the third metal wire being connected to the first metal wire and the second metal wire, respectively, and dividing the first metal wire into a first radiation portion and a second radiation portion; and a fourth metal wire having at least a part being located between the second radiation portion and the second metal wire;

wherein the fourth metal wire is not connected to the first metal wire, the second metal wire and the third metal wire, the fourth metal wire forms multiple bends and has a first impedance matching portion and a feed point, and part of the fourth metal wire coincides with the second radiation portion in a projection direction.

2. The planar multi-band antenna according to claim 1, wherein the first metal wire and the third metal wire are in a "T" shape or a "Y" shape.

3. The planar multi-band antenna according to claim 1, wherein the second metal wire is planar.

4. The planar multi-band antenna according to claim 1, further comprising:

a metal sheet electrically connected to the second metal wire.

5. The planar multi-band antenna according to claim 4, wherein the metal sheet covers the second metal wire.

6. The planar multi-band antenna according to claim 1, wherein the grounding point and the feed point are disposed opposite to each other.

7. The planar multi-band antenna according to claim 1, wherein the fourth metal wire further has a third radiation portion and a fourth radiation portion, an end of the fourth radiation portion is connected to an end of the third radiation portion, and an other end of the fourth radiation portion is connected to an end of the first impedance matching portion, and the first impedance matching portion has the feed point.

8. The planar multi-band antenna according to claim 7, wherein the third radiation portion and the second radiation portion are parallel with each other, and part of the third radiation portion coincides with the second radiation portion in the projection direction.

9. The planar multi-band antenna according to claim 7, wherein the first impedance matching portion is disposed between the second radiation portion and the second metal wire, and part of the first impedance matching portion coincides with the second radiation portion in the projection direction.

10. The planar multi-band antenna according to claim 7, wherein the third radiation portion is disposed between the second radiation portion and the first impedance matching portion.

11. The planar multi-band antenna according to claim 7, wherein the second radiation portion is disposed between the third radiation portion and the first impedance matching portion.

12. The planar multi-band antenna according to claim 7, wherein the fourth metal wire further includes a second impedance matching portion protruded from the fourth radiation portion.

13. The planar multi-band antenna according to claim 1, wherein the third metal wire and the second radiation portion are operated in a first bandwidth.

14. The planar multi-band antenna according to claim 13, wherein the third metal wire and the first radiation portion are operated in a second bandwidth.

15. The planar multi-band antenna according to claim 14, wherein the first radiation portion and the second radiation portion are operated in a third bandwidth.

16. The planar multi-band antenna according to claim 15, wherein part of the fourth metal wire is operated in a fourth bandwidth.

* * * * *